US010113840B2

(12) United States Patent
Farnsworth

(10) Patent No.: US 10,113,840 B2
(45) Date of Patent: Oct. 30, 2018

(54) REACTIVE TARGET FOR USE WITH FIREARMS

(71) Applicant: David P. Farnsworth, Lindon, UT (US)

(72) Inventor: David P. Farnsworth, Lindon, UT (US)

( * ) Notice: Subject to any disclaimer, the term of this patent is extended or adjusted under 35 U.S.C. 154(b) by 103 days.

(21) Appl. No.: 15/060,293

(22) Filed: Mar. 3, 2016

(65) Prior Publication Data

US 2017/0254626 A1 Sep. 7, 2017

(51) Int. Cl.

| | |
|---|---|
| ***F41J 5/00*** | (2006.01) |
| ***F41J 5/14*** | (2006.01) |
| ***F41J 7/04*** | (2006.01) |
| ***F41J 5/26*** | (2006.01) |

(52) U.S. Cl.

CPC ..... *F41J 5/26* (2013.01)

(58) Field of Classification Search

CPC . F41J 5/26; B65D 63/10; B65D 77/06; A63B 43/00; B29C 51/00

USPC ..... 273/380; 206/219

See application file for complete search history.

(56) References Cited

U.S. PATENT DOCUMENTS

| | | | | |
|---|---|---|---|---|
| 3,819,107 A * | 6/1974 | Ryder, Jr. | ..... | B65D 63/1027 206/219 |
| 4,921,250 A * | 5/1990 | Ayres | ..... | A63B 43/00 273/317 |
| 7,270,233 B2 * | 9/2007 | Kindt | ..... | B65D 51/28 206/219 |

* cited by examiner

*Primary Examiner* — Gene Kim
*Assistant Examiner* — Christopher Glenn
(74) *Attorney, Agent, or Firm* — Durham Jones & Pinegar, P.C., Intellectual Property Law Group

(57) ABSTRACT

A reactive target for use in target practice with a firearm is configured to, when hit by a projectile, such as a bullet, from a firearm with sufficient force, disperse a material in a manner that provides a visible report of the shooter's results from close up or from a long distance and directly and immediately to the shooter. The reactive target includes an inner container that carries a non-compressible material and an outer container that carries the inner container and a dispersible material, which may be a compressible material. The reactive target is particularly useful with high velocity, high impact force firearms. Methods for making the reactive target and methods of target practice using the reactive target are also disclosed.

18 Claims, 2 Drawing Sheets

REACTIVE TARGET FOR USE WITH FIREARMS

TECHNICAL FIELD

This disclosure relates generally to reactive targets for use in target practice with firearms and, more specifically, to reactive targets that generate reactions that are visible from relatively long distances when hit with projectiles shot from firearms. Even more specifically, this disclosure relates to reactive targets that generate visible reactions by way of kinetic energy, rather than chemically.

RELATED ART

A variety of different types of targets have been used for target practice with firearms. At short distances, a conventional paper target (e.g., a round target, a silhouette target, etc.) may be used to provide an individual shooter with some indication of his or her abilities as a marksman with a particular firearm.

When target practice is conducted at long distances, as is often the case with rifles, it is often difficult for an individual shooter to immediately determine his or her accuracy and, at some distances, whether or not he or she even hit the target. Shooters often desire some sort of direct and immediate report, such as a visible report or an audible report, of the results of a particular shot. Bottles, cans, melons and a variety of other articles have long been used because of the reports that they can provide to a shooter. Due to recoil of the firearm, when a shooter uses a scope to aim at a target, the shooter typically cannot keep an eye on the target after he or she pulls the trigger to make the shot. Thus, at particularly long distances (e.g., about one hundred yards or more), many conventional targets do not provide the shooter with a direct and immediate knowledge of the result of a particular shot, or with the thrill that often accompanies a particularly difficult shot.

Some long range targets have been developed to provide the types of reports that are typically desired by rifle shooters. These long range targets typical provide a report through a chemical reaction that generates an explosion. Because explosions are usually accompanied by the risk of damage, including fire damage, most public lands prohibit the use of chemically reactive long range targets.

SUMMARY

In various aspects and embodiments, this disclosure includes reactive targets that may provide an immediate and direct report to a shooter from any distance, including relatively short distances and long distances, as well as methods for making such a reactive target and methods for using such a reactive target.

In one aspect, a reactive target is disclosed. The reactive target may be configured for long range use. More specifically, upon being hit by a bullet, the reactive target may provide a shooter with an immediate and direct visible report. In some embodiments, the reactive target may provide a shooter with an immediate and direct visible report from a distance of about 100 yards or even from longer distances.

A reactive target according to this disclosure may include an outer container, an inner container, a non-compressible material and a compressible material.

The outer container may have an opening or it may be configured to be opened. In any event, an interior of the outer container, which may also be referred to herein as an "outer receptacle" of the reactive target, may be exposed during use of the reactive target. The interior of the outer container is configured to receive and carry the inner container and the compressible material. The outer container may comprise a box (e.g., a paper box, a cardboard box, etc.). The box may include a lid, which may be closed and, optionally, sealed for storage and/or transportation prior to use of the reactive target. In some embodiments, the outer container may also comprise a bag, which may be placed within the box. In other embodiments, the outer container may comprise, consist essentially of or consist of a bag. An interior of the bag may define the interior of the outer container.

On an exterior surface, the outer container of the reactive target may comprise a target feature, or a mark, such as a circle or dot, another shape, an image or the like, that may be viewed by a shooter from a long distance (e.g., about 100 yards or more, etc.), either with his or her naked eye or with the assistance of a scope or other optical enhancement.

The inner container has an interior, which is also referred to herein as an "inner receptacle" of the reactive target, and which may be closed. In some embodiments, the inner container may be sealed. Thus, the inner container may include a lid, which may be closed onto and even sealed onto a remainder of the inner container to close and, optionally, to seal the interior of the inner container. Without limitation, the inner container may comprise a can (e.g., an aluminum can, a tin can, a tin-coated steel can, a tin-free steel can, another thin metal can, etc.), a plastic container (e.g., a bottle, etc.) or another thin-walled container that may be closed and, optionally, sealed. The interior container may be configured to contain the non-compressible material in a fluid-tight manner.

The non-compressible material may comprise water or an aqueous liquid.

The compressible material, which be held within the interior of the outer receptacle, may comprise a dispersible agent, such as a powder. Some embodiments of compressible material, when dispersed, may have the appearance of a cloud (e.g., a cloud in the sky, a cloud of smoke, etc.). The compressible material may be configured, when dispersed, to be readily visible. When the compressible material is dispersed, it may be viewed from any distance—even long distances (e.g., about 100 yards or more, etc.). Thus, the compressible material may have a color that renders it readily distinguishable from a background environment (e.g., the sky; trees; rocks, dirt and/or vegetation on a hill or mountain; etc.). In some embodiments, the compressible material may comprise a material that is environmentally safe or even chemically inert. A non-limiting example of such a material is chalk (i.e., calcite, or calcium carbonate ($CaCO_3$), such as a line marking chalk).

A reactive target may be made by providing a first container (i.e., the inner container) that carries and encloses a non-compressible material, such as water or an aqueous liquid. That container (i.e., the inner container) may be placed within the interior of a second container (i.e., the outer container). In some embodiments, placement of the first container within the second container may comprise placement of the first container directly within a box. In other embodiments, the first container may be placed within a bag that is, in turn (before, during or after placement of the first container therein), placed within a box.

A compressible material, which may be configured to be dispersed visibly, may also be placed within the interior of the second container. The compressible material may be placed on a top or lid of the first container (i.e., the outer container) and, in some embodiments, between an outer side surface of the first container (i.e., the inner container) and an inner side surface of the second container (i.e., the outer container).

The second container may, in embodiments where it includes a closure, such as a lid, be closed. Optionally, the second container may also be sealed. Closure and optional sealing of the second container may ensure that its contents remain in place during storage, transportation and placement at a target location, or a target site.

Use of a reactive target according to this disclosure may include placing a reactive target according to this disclosure on a solid surface. The location at which the reactive target is placed may be referred to as a "target location." In embodiments where the outer container of the reactive target is sealed, it may be unsealed. In embodiments where the outer container of the reactive target is closed, it may be opened. Opening the outer container of the reactive target may expose the compressible material contained thereby, without removing the compressible material from the interior of the outer container. When placed at the target location, the target may be visible from a remote shooting location, or shooting site (e.g., by naked eye, with the assistance of a scope or other optical enhancement, etc.).

The shooting location may be spaced away from the target location. In some embodiments, the shooting location may be relatively close to the target location. In other embodiments, the shooting location may be positioned a long distance away from the target location. Without limitation, a long distance between the shooting location and the target location may be about 100 yards, more than one hundred yards, about 150 yards, about 200 yards, about 250 yards, about 300 yards or any distance suitable for target practice with a high velocity firearm (e.g., a center-fired rifle; a large caliber (e.g., greater than 9 mm, 0.357 inch, etc.), high-velocity pistol (e.g., with a bullet speed of more than about 900 feet per second (ft/s), more than about 1,150 ft/s, etc.); etc.). From the shooting location, a shooter may take aim at the reactive target or a target feature, or mark, thereon. Once the shooter has taken aim at the reactive target, he or she may fire the firearm, or cause the firearm to shoot a projectile, such as a bullet, toward the reactive target.

When a high-velocity projectile (e.g., a projectile, such as a bullet, shot from a firearm; a bullet having a velocity of about 1,150 ft/s or more; a bullet having a velocity of about 3,200 ft/s or more, etc.) impacts the non-compressible material of the reactive target, kinetic energy from the bullet is transferred into the non-compressible material, which may "blow" a portion of the inner container (e.g., a lid, etc.) off of and away from a remainder of the inner container and/or the kinetic energy may cause the non-compressible material and the inner container to explode. The kinetic energy from the non-compressible material and/or the inner container may be transferred to the compressible material, and may cause the compressible material to disperse from the outer container of the reactive target (e.g., to form a cloud above, adjacent to or around the reactive target, etc.). In some embodiments, kinetic energy from the non-compressible material, the inner container and/or the compressible material may cause the outer container to explode. As the compressible material is dispersed, it may be viewed by the shooter with his or her naked eye; i.e., without the aid of a scope or other optical enhancement. The remainder of the inner container may remain in place at the target location.

Other aspects, as well as features and advantages of various aspects, of the disclosed subject matter will become apparent to those of ordinary skill in the art through consideration of the ensuing description, the accompanying drawings and the appended claims.

DETAILED DESCRIPTION

Figure 1:
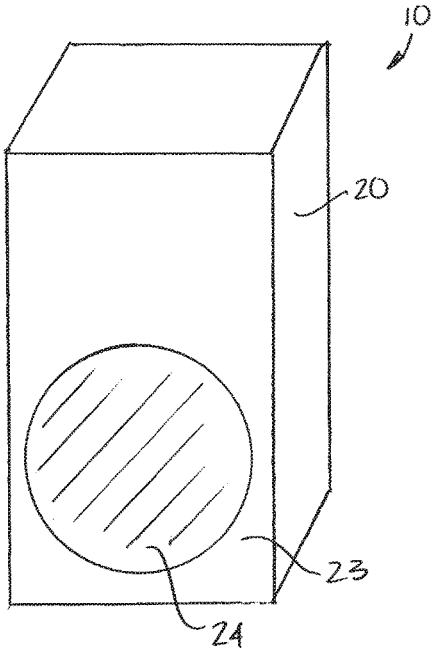
FIG. 1 is a perspective view of an embodiment of a reactive target according to this disclosure.
Figure 2:
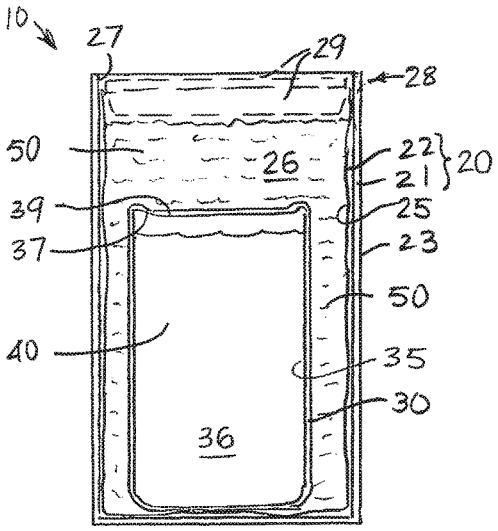
FIG. 2 is a cross-sectional representation of the embodiment of reactive target shown in FIG. 1.

FIGS. 1 and 2 illustrate an embodiment of a reactive target 10 according to this disclosure. As seen in FIG. 1, the reactive target 10 includes an outer container 20. The embodiment of reactive target 10 depicted by FIG. 1 includes an outer container 20 that comprises a box. The box may comprise an outer element 21, or shell, of the outer container 20. In addition to the outer element 21, or shell, the outer container may comprise an inner element 22, or liner, such as the bag shown in FIG. 2.

On its outer surface 23 (or on an outer surface of its outer element 21), the outer container 20 may carry a target feature 24, or a mark, such as the illustrated circle or dot or another shape, an image or the like. The target feature 24 may have a size, color and/or configuration that enables it to be readily viewed by a shooter from. The target feature 24 may be configured (e.g., it may have one or more of a shape, dimensions and a color that enable it) to be viewed by a shooter from a long distance (e.g., about 100 yards or more, a rifle target shooting distance, etc.), either with his or her naked eye or with the assistance of a scope or other optical enhancement. The target feature 24 may be positioned on the outer surface 23 at a location that, if the target feature 24 is hit by a projectile, such as a bullet, will provide a desired effect, as will be disclosed in further detail hereinafter.

As illustrated by FIG. 2, an interior surface 25 of the outer container 20 (or of its inner element 22) may define an interior 26 of the outer container 20 and, thus, an outer receptacle of the reactive target 10.

The outer container 20 may include an opening 27. In the depicted embodiment, the opening 27 is located at a top 28 of the outer container 20. The opening 27 may be configured to be closed by way of a lid or another suitable cover 29. When the opening 27 of the outer container 20 is open (e.g., when a cover 29 has been removed from the opening 27 of the outer container 20, etc.), the interior 26 of the outer container 20 may be exposed, as may the contents of the interior 26. When the opening 27 of the outer container 20 is closed (e.g., when a cover 29 covers the opening 27, etc.), the contents of the interior 26 of the outer container 20 may be enclosed within and, optionally, sealed within, the interior 26.

FIG. 2 shows the contents of the interior 26 of the outer container 20, which contents comprise additional elements of the reactive target 10. As illustrated, an inner container 30 may be disposed within the interior 26 of the outer container 20. In various embodiments, the inner container 30 may comprise a can (e.g., an aluminum can, a tin can, a tin-coated steel can, a tin-free steel can, another thin metal can, etc.), a plastic container (e.g., a bottle, etc.) or another thin-walled container that may be closed and, optionally, sealed.

An interior surface 35 of the inner container 30 at least partially defines an interior 36 of the inner container 30. In addition, the interior 36 of the inner container 30 may be partially defined by a cover 39 (e.g., a lid, etc.), which may be positioned over an opening 37 in the inner container 30. The interior 36 serves as an inner receptacle of the reactive target 10. The interior 36 may be configured to contain a fluid (e.g., a liquid, etc.). Thus, the interior 36 and the inner container 30 may be configured to be sealed (e.g., a cover 39 may be sealed in place over an opening 37, etc.).

The inner container 30 may include a relatively weak element, such as a cover 39 over an opening 37. Such a relatively weak element may be configured to enable the contents of the interior 36 of the inner container 30 to escape from or to be otherwise removed from the inner container 30.

A non-compressible material 40 may be located within the interior 36 of the inner container 30. Without limiting the scope of the non-compressible material 40 or other possible contents of the interior 36 of the inner container 30, the non-compressible material 40 may comprise water or an aqueous liquid (e.g., beer, carbonated water, a soft drink, etc.). The non-compressible material 40 may be configured to transfer kinetic energy from a bullet that pierces a wall of the inner container 30 and enters the non-compressible material 40 to one or more parts of the inner container 30. In embodiments where the inner container 30 includes a relatively weak element, such as a cover 39 (e.g., a lid, etc.), the non-compressible material 40 may be configured to transmit kinetic energy from a bullet to the cover 39, which may enable or cause the cover 39 to be discharged, or blown off of or away from, an opening 37 of the inner container 30.

In addition to the inner container 30 and its contents, the interior 26 of the outer container 20 may hold a compressible material 50. As illustrated by FIG. 2, the compressible material 50 may be located adjacent to (e.g., on, etc.) a cover 39 of the inner container 30. The compressible material 50 may also or may alternatively be placed at other locations between an outer surface 33 of the inner container 30 and the inner surface 25 of the outer container 20.

The compressible material 50 may comprise a dispersible agent, such as a powder. Some embodiments of compressible material 50, when dispersed, may have the appearance of a cloud (e.g., a cloud in the sky, a cloud of smoke, etc.) that may be viewed by a shooter directly, with his or her naked eye, immediately upon hitting the target with a bullet. When dispersed, the compressible material 50 is certainly visible from relatively close distances, but may also be visible from long distances (e.g., about 100 yards or more, etc.). In some embodiments, a color or another characteristic of the compressible material 50 may enable it to be readily distinguished from a background environment (e.g., the sky; trees; rocks, dirt and/or vegetation on a hill or mountain; etc.) when the compressible material 50 is dispersed. In some embodiments, the compressible material 50 may be environmentally safe or even chemically inert. A non-limiting example of such a material is chalk (i.e., calcite, or calcium carbonate ($CaCO_3$)), such as a line marking chalk.

Figure 3:
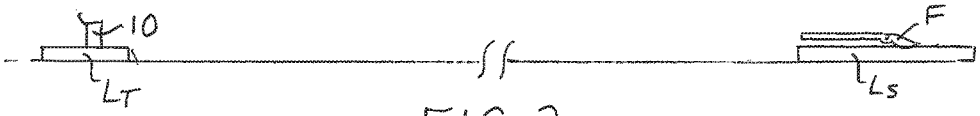
FIG. 3 illustrates use of an embodiment of reactive target while conducting target practice with a firearm, such as a rifle.
Figure 4:
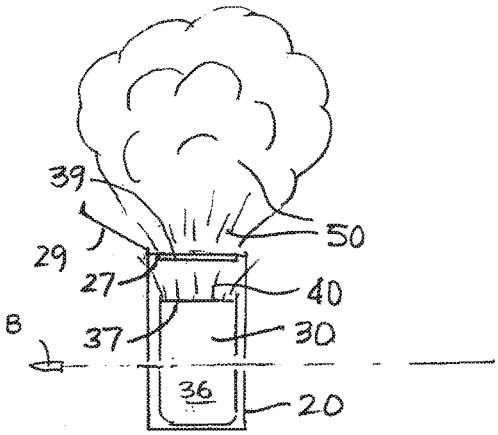
FIG. 4 is a cross-sectional representation of the embodiment of reactive target shown in FIGS. 1 and 2, depicting various events that occur as a bullet hits the reactive target.
Figure 5:
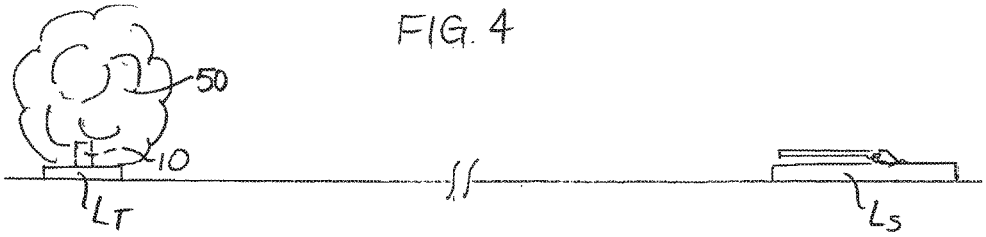
FIG. 5 provides a representation of a visible report provided by a reactive target of this disclosure.

Turning now to FIGS. 3-5, an embodiment of target set-up and practice using a reactive target 10 is illustrated and described. As shown in FIG. 3, one or more reactive targets 10 may be placed on a solid surface at a target location $L_T$. In some embodiments, the outer container 20 (FIG. 2) of each reactive target 10 may be opened, which may enable the compressible material 50 (FIG. 2) to exit the outer container 20. The target location $L_T$ may be spaced a desired distance away from a shooting location $L_S$, from which one or more shooters will aim and shoot at the reactive target(s) 10 with one or more firearms F. The desired distance the target location $L_T$ is spaced apart from the shooting location $L_S$ may be any distance, including relatively close distances and longer distances. In embodiments where the target location $L_T$ is positioned a long distance away from the shooting location $L_S$, the suitable long distance may be about 100 yards or more, about 150 yards, about 200 yards, about 250 yards, about 300 yards or any distance suitable for target practice with a firearm. While a reactive target 10 according to this disclosure may be used with any firearm, its reaction is particularly exciting when hit with a projectile, such as a bullet, shot from a high velocity firearm (e.g., a center-fired rifle; a large caliber (e.g., greater than 9 mm, 0.357 inch, etc.), high-velocity pistol (e.g., with a bullet speed of more than about 900 ft/s, more than about 1,150 ft/s, etc.); etc.).

FIG. 4 provides a representation of various actions that may occur if a bullet or another projectile B hits the reactive target 10. If a bullet or another projectile pierces both the outer container 20 and the inner container 30 with sufficient force (e.g., about 300 ft. lbs., about 1,000 ft. lbs., etc.), kinetic energy may be transferred from the projectile P to a non-compressible material 40 within the interior 36 of the inner container 30. The kinetic energy within the non-compressible material 40 may then be transferred to the inner container 30. Such a transfer of kinetic energy may cause a cover 39 of the inner container 30 (e.g., a lid of a can, a cap on the inner container 30, etc.) to be removed from an opening 37 of the inner container 30. As the cover 39 is blown away from a remainder of the inner container 30 and, optionally, as the non-compressible material 40 exits the interior 36 of the inner container 30, the cover 39 and, optionally, the non-compressible material 40 may transmit kinetic energy to the compressible material 50, which may cause the compressible material 50 to disperse. When an opening 27 of the outer container 20 is open, the compressible material 50 may be readily dispersed to locations outside of the outer container 20 and, thus, to locations outside of the reactive target 10, which may result in a cloud of compressible material 50 that may be readily seen a distance from the reactive target 10; for example, from the shooting location $L_S$, as illustrated by FIG. 5. Additionally, the transfer of kinetic energy from the non-compressible material 40 to the inner container 30 could cause the inner container 30 to explode. The transfer of kinetic energy from the non-compressible material 40 and/or the inner container 30 may also cause the outer container 20 to explode and the compressible material 50 to visibly disperse (e.g., from the shoot location $L_S$, etc.) from a location where the reactive target 10 was placed before it was hit by the projectile B.

With returned reference to FIGS. 1 and 2, the manner in which the compressible material 50 is dispersed from the reactive target 10 may depend, at least in part, on the location at which a projectile, such as a bullet, impacts the reactive target 10. Without limitation, a projectile that impacts the reactive target 10 at a location near its bottom may cause the compressible material 50 to disperse in an upward direction. A projectile that impacts the reactive target 10 at a location near its top may cause the compressible material 50 to disperse outwardly and down. The target feature 24 may be positioned on the outer surface 23 of the outer container 20 in a manner that, if a projectile passes through the target feature 24, the compressible material 50 will disperse in a desired manner. As an example, the target feature 24 of a reactive target 10 that is intended for use from a relatively close range (e.g., less than 100 yards, etc.) may be positioned nearer the top of the reactive target 10 than its bottom. As another example, a target feature 24 of a reactive target 10 that is intended for use from a relatively long range (e.g., 100 yards or more, etc.) may positioned closer to the bottom of the reactive target 10.

Although the preceding description provides many specifics, these should not be construed as limiting the scope of the invention recited by any of the appended claims, but merely as providing information pertinent to some specific embodiments that may fall within the scope of one or more of the appended claims. Features from different embodiments may be employed in combination. In addition, other embodiments may also lie within the scopes of the appended claims. All additions to, deletions from and modifications of the disclosed subject matter that fall within the scopes of the claims are to be embraced by the claims.

What is claimed:

1. A reactive firearm target, comprising: an outer container including an outer receptacle and an interior surface, the outer container including at least one opening; an inner container within the outer receptacle of the outer container, exterior side surfaces of the inner container being spaced apart from interior side surfaces of the outer container, the inner container including an inner receptacle and an exterior surface; a fluid within the inner receptacle of the inner container, the fluid comprising a non-compressive material that, upon impacting being impacted by a projectile shot by a firearm, is capable of forcefully exiting the inner receptacle of the inner container; and a dispersal agent within the outer receptacle of the outer container, substantially filling a space between the interior side surfaces of the outer container and the exterior side surfaces of the inner container, the dispersal agent capable of being exposed through the at least one opening of the outer container, the dispersal agent comprising a compressive material that, upon being impacted by the fluid forcefully exiting the inner receptacle of the inner container, is capable of being visibly dispersed from the outer container.

2. The reactive firearm target of claim 1, wherein the outer container comprises a box.

3. The reactive firearm target of claim 2, wherein the outer container further comprises a bag within the box.

4. The reactive firearm target of claim 3, wherein an interior of the bag comprises the outer receptacle of the outer container and holds the inner container and the dispersal agent.

5. The reactive firearm target of claim 1, wherein the inner container comprises a can.

6. The reactive firearm target of claim 5, wherein the fluid comprises water.

7. The reactive firearm target of claim 5, wherein the dispersal agent is located on top of the can.

8. The reactive firearm target of claim 7, wherein the dispersal agent on top of the can has a thickness of at least about one inch.

9. The reactive firearm target of claim 1, wherein the dispersal agent comprises a powder.

10. The reactive firearm target of claim 9, wherein the powder comprises line marking chalk.

11. The reactive firearm target of claim 1, wherein the outer container comprises a bag.

12. The reactive firearm target of claim 1, wherein neither the fluid nor the dispersal agent causes a chemical reaction when impacted by the projectile shot by the firearm.

13. The reactive firearm target of claim 1, further comprising:

a target feature on the outer container, the target feature identifying a location through which the projectile can pass through the outer container, through the dispersal agent, through the inner container, and into the fluid.

14. The reactive firearm target of claim 13, wherein a position of the target feature on the outer container corresponds to a location that, if impacted by the projectile shot by the firearm, will cause the dispersal agent to disperse from the outer container in a desired manner.

15. A reactive firearm target, comprising: an outer container including an outer receptacle and an interior surface, the outer container including at least one opening, the outer container comprising: a box; a target feature on an outer surface of the outer container; an inner container within the outer receptacle of the outer container, exterior side surfaces of the inner container being spaced apart from interior side surfaces of the outer container, the inner container including an inner receptacle and an exterior surface, the inner container comprising: a can; a fluid within the inner receptacle of the inner container, the fluid comprising a non-compressive material that, upon being impacted by a projectile shot by a firearm, is capable of forcefully exiting the inner receptacle of the inner container; and a dispersal agent within the outer receptacle of the outer container, filling a space between the interior side surfaces of the outer container and the exterior side surfaces of the inner container and covering the inner container, the dispersal agent capable of being exposed through the at least one opening of the outer container, the dispersal agent comprising a compressive material that, upon being impacted by the fluid forcefully exiting the inner receptacle of the inner container, is capable of being visibly dispersed from the outer container.

16. The reactive firearm target of claim 15, wherein:

the fluid comprises water; and the dispersal agent comprises a powder.

17. The reactive firearm target of claim 15, wherein a position of the target feature on the outer container corresponds to a location that, if impacted by the projectile shot by the firearm, will cause the dispersal agent to disperse from the outer container in a desired manner.

18. A reactive firearm target, comprising:

an outer container including an outer receptacle and an interior surface, the outer container including at least one opening, the outer container comprising:

a box; and a bag within the box, an interior of the bag comprising the outer receptacle of the outer container;

an inner container within the outer receptacle of the outer container, exterior side surfaces of the inner container being spaced apart from interior side surfaces of the outer container, the inner container including an inner receptacle and an exterior surface, the inner container comprising:

a can;

a fluid comprising water within the inner receptacle of the inner container that, upon being impacted by a projectile shot by a firearm, is capable of forcefully exiting the inner receptacle of the inner container;

a dispersal agent comprising a compressible powder within the outer receptacle of the outer container that, upon being impacted by the fluid forcefully exiting the inner receptacle of the inner container, is capable of being visibly dispersed from the outer container, the dispersal agent filling a space between the interior side surfaces of the outer container and the exterior side surfaces of the inner container and covering the inner container; and a target feature on an outer surface of the outer container, a position of the target feature on the outer container corresponding to a location that, when impacted by the projectile shot by the firearm, will cause the fluid within the inner receptacle of the inner container to forcefully exit the inner container and cause the dispersal agent to disperse from the outer container in a manner visible by the naked eye from a distance of at least 100 yards.

* * * * *